United States Patent [19]

Wilson

[11] 4,157,197

[45] Jun. 5, 1979

[54] AUTOMATIC BOLT MECHANISM

[76] Inventor: Timothy F. Wilson, Flat 10, 14-18 Sheehy St., GLEBE, Sydney, New South Wales, Australia, 2037

[21] Appl. No.: 781,950

[22] Filed: Mar. 28, 1977

[30] Foreign Application Priority Data

Apr. 6, 1976 [AU] Australia ..... 5505/76

[51] Int. Cl.[2] ..... E05C 1/08

[52] U.S. Cl. ..... 292/179; 292/180

[58] Field of Search ..... 292/163, 174, 177, 178, 292/179, 180, 182

[56] References Cited

U.S. PATENT DOCUMENTS 2,178,313 10/1939 Rossiter et al. ..... 292/181

FOREIGN PATENT DOCUMENTS 359623 1/1906 France ..... 292/177

28476 7/1903 Switzerland ..... 292/177

*Primary Examiner*—Thomas J. Holko

[57] ABSTRACT

An automatic latch bolt mechanism for a door. A spring loaded rod structure stores energy upon closing the door and the mechanism automatically draws the bolt upon being triggered by a simple act such as pushing a button.

4 Claims, 8 Drawing Figures

AUTOMATIC BOLT MECHANISM

BACKGROUND OF THE INVENTION

This invention relates to a latch bolt mechanism for a door, and particularly to a latch bolt mechanism in which the bolt may be drawn to open the door by use of energy stored in the mechanism as the door is being closed.

In conventional latch bolt mechanisms, the bolt is drawn by turning a key or a handle. Such mechanisms are not entirely suitable for certain special applications; for example where the user is unable through age or incapacity to operate the handle or key conveniently. When conventional latch bolt mechanisms are operated electronically, the energy required to draw the bolt necessitates not only greater power usage but additional machinery which cannot always be conveniently located on or in the door, and also adds substantially to the cost of the mechanism.

OBJECTS OF THE INVENTION

It is an object of the present invention to provide a latch bolt mechanism whereby the bolt may be drawn by a simple physical act such as the touch of a button.

It is a further object of the invention to provide a latch bolt mechanism in which the energy required to draw the bolt upon opening the door is stored by the mechanism as the door is being closed.

It is another object of the invention to provide a latch bolt mechanism which may be operated by incapacitated persons.

It is yet another object of the invention to provide a latch bolt mechanism which is particularly suitable for remote electronic operation.

Other objects and advantages of the present invention will become apparent as the invention is described with reference to the accompanying drawings.

SUMMARY OF THE INVENTION

According to the present invention there is provided a latch bolt mechanism for a door, which mechanism is adapted to co-operate with a striker plate. The mechanism comprises, in combination, frame means adapted to be mounted in fixed relationship to said door; a plunger rod having a head end and a tail end and movable relative to said frame means longitudinally between a first limiting position in the direction defined by its head end and a second limiting position in the direction defined by its tail end and having means associated with its head end to engage said striker plate when said door is closed whereby said rod is prevented from attaining its said first limiting position;

first spring means tending to urge said rod towards its first limiting position relative to said frame means;

a bolt slidably mounted on said rod near its head end and movable relative to said frame means between a protrudent position at which in use it may engage said striker plate and a withdrawn position at which in use it will clear said striker plate;

an actuator slidable on said rod relative to each of said frame means and said bolt and limited in its ability to move towards the tail end of said rod relative to said bolt by means on said actuator which engage co-operating means on said bolt;

second spring means tending to urge said actuator relative to said bolt towards the tail end of said rod;

third spring means tending to urge said actuator relative to said rod towards the tail end of said rod; and releasable retaining means movable relative to said frame means able to lock said actuator in a fixed position relative to said frame means against the influence of said second and third spring means.

Conveniently, the frame means consists of a casing which houses the mechanism, and which can be either mounted by bolts and or screws on to one of the faces of the door, or may be mortised within the body of the door. The plunger rod may be housed substantially within such a casing, and conveniently may extend through a hole in an end wall of the casing which supports it but leaves it free to slide along its axis.

In one simple and preferred form of the invention, the outer end of the plunger rod extends through or adjacent to the bolt head so that it may directly engage the striker plate.

The first, second and third spring means may conveniently be compression springs which are sleeved along the plunger rod. Alternatively some or all of the spring means may comprise leaf springs cantilevered from the interior of the casing.

The releasable retaining means is preferably a member which moves in and out of the path of the slide actuator by linear or rotational movement in a plane perpendicular to the axis of the rod. In one preferred form of the invention, the retainer is operated against a spring load by a push-button extending through the casing on one side of the door Alternatively it may be operable from either side of the door by depression of one of a pair of opposed push buttons which allow movement in either direction against one of a pair of compression springs.

By way of example, one preferred embodiment of the invention is described with reference to the accompanying drawings.

DETAILED DESCRIPTION OF THE DRAWINGS

Figure 1:
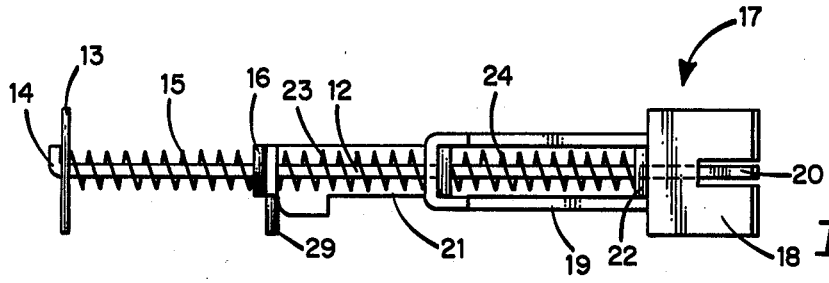
FIG. 1 is a diagrammatic, longitudinal, side elevation of a latch bolt assembly according to the invention, shown in the configuration in which it appears when the door is open.
Figure 2:
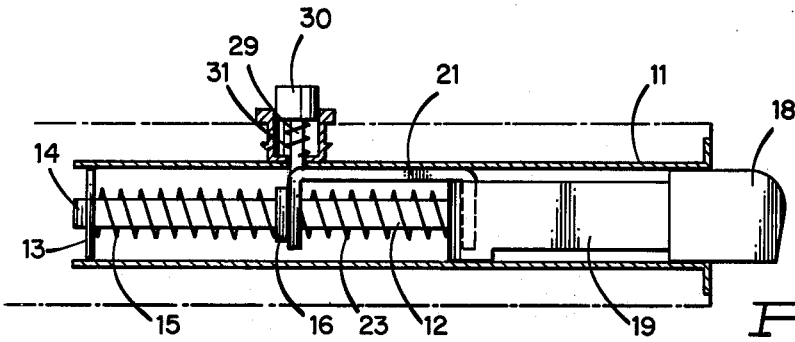
FIG. 2 is a longitudinal sectional plan view of the latch bolt assembly according to FIG. 1, in the configuration of FIG. 1.

As best seen in FIG. 2, the latch bolt assembly is housed in a casing 11 which may be rigidly mounted on a door. In FIGS. 1 and 6 to 8, the walls of casing 11 have been omitted for clarity. A plunger rod 12 of rectangular cross section runs longitudinally within casing 11, with one end passing through the end wall 13 of casing 11. Relative motion between plunger rod 12 and casing 11 is limited in one direction by the abutment of the turned up end 14 of plunger rod 12 with end wall 13, and relative movement in the opposite direction is resisted by a first compression spring 15 which is located between end wall 13 and a rear abutment flange 16 which is rigidly mounted on plunger rod 12.

Mounted on the other end of plunger rod 12, is a bolt denoted generally as 17 which comprises a head 18 to which is rigidly attached a stirrup shaped stem 19. As seen in FIG. 1, the bolt head 18 is forked to expose the outer end 20 of plunger rod 12.

Also mounted on plunger rod 12 is a slide actuator 21 which is able to move between rear abutment flange 16 and a front abutment flange 22 rigidly mounted on plunger rod 12. As best seen in FIG. 1, slide actuator 21 overlaps stirrup shaped stem 19 so that the two members cannot be moved further apart than they appear in FIGS. 1 and 2. A second compression spring 23 urges slide actuator 21 and stirrup shaped stem 19 to maintain the relative position they occupy in FIGS. 1 and 2, while a third compression spring 24 urges slide actuator 21 against rear abutment flange 16.

Figure 3:
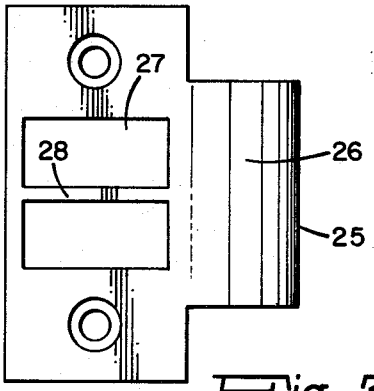
FIG. 3 is a side elevation of a striker plate adapted to co-operate with the assembly according to FIG. 1.
Figure 4:
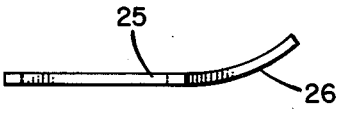
FIG. 4 is a plan view of the striker plate according to FIG. 3.

As seen in FIGS. 3 and 4, co-operating striker plate denoted generally as 25 has a curved apron 26 and a bolt head engaging recess 27. Striker plate 25 differs from conventional striker plates in that it has a bridge portion 28 across recess 27.

As seen in FIG. 2, the cam surface profile of the preferred bolt head according to the illustrated embodiment of the invention is unconventional in that its outer end surface is tapered back towards the trailing side. Accordingly, contact of its leading edge with the apron of the striker plate will cause depression of the bolt head to take place somewhat more abruptly than is the case with conventionally shaped bolts. This feature assists in the efficient working of the mechanism, but is by no means essential, and the invention can equally be applied to conventionally shaped bolts.

Figure 5:
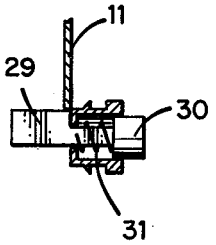
FIG. 5 is a transverse sectional elevation through part of the assembly according to FIGS. 1 and 2.
Figure 6:
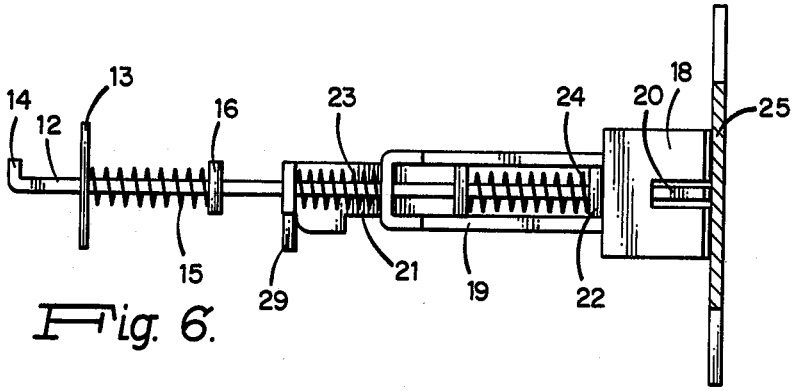
FIG. 6 is a view similar to FIG. 1 of the assembly according to FIG. 1, but shown in the configuration in which it appears as the door is closing against a striker plate according to FIGS. 3 and 4.

The manner of operation of the latch bolt mechanism is illustrated with reference to FIGS. 6, 7 and 8. As the door is swung closed, the bolt head 18 engages the apron 26 of the striker plate 25. Owing to the curvature of apron 26 and the cam shaping of bolt head 18, the bolt 17 is pushed back into casing 11. Because of the abutment of bolt head 18 with the front abutment flange 22, plunger rod 12 is also moved longitudinally through end wall 13 of casing 11. Slide actuator 21, however, is prevented from moving relative to the casing as a result of its engagement with a releasable retainer 29. As best seen in FIGS. 2 and 5, releasable retainer 29 is movable transversely of casing 11 by depression of a push button 30 against a fourth compression spring 31. In its normal position, retainer 29 prevents movement of slide actuator 21 towards end wall 13. As seen in FIG. 6, the operation of closing the door therefore forces first, second and third compression springs 15, 23 and 24 into compression.

Figure 7:
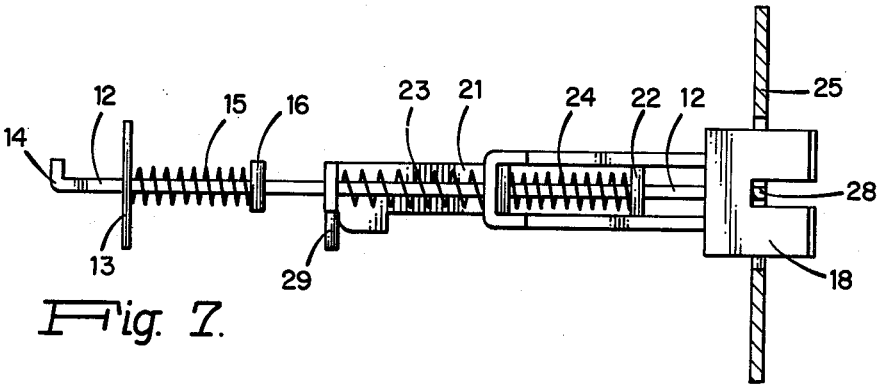
FIG. 7 is a view similar to FIG. 6 of the assembly according to FIG. 6, but shown in the configuration in which it appears when the door is fully closed in interaction with the striker plate.
Figure 8:
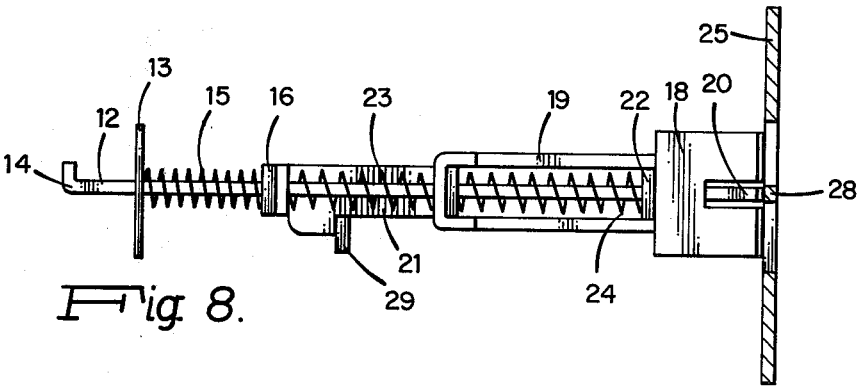
FIG. 8 is a view similar to FIGS. 6 and 7 of the assembly according to FIGS. 6 and 7, but shown in the configuration in which it appears when the bolt has been drawn to allow the door to be opened.

When the door is fully closed, as shown in FIG. 7, bolt head 18 is free to enter recess 27 of striker plate 25, and is pushed into that recess by the action of second compression spring 23 acting on stirrup shaped stem 19. The outer end 20 of plunger rod 12 is engaged by bridge piece 28 of striker plate 25, thereby continuing to hold first and third compression springs 15 and 24 in their compressed state.

When the door is in its closed state, button 30 may be depressed against fourth compression spring 31 to move retainer 29 into a position where it no longer prevents the movement of slide actuator 21 towards end wall 13. Third compression spring 24 then moves the slide actuator which, by virtue of its engagement with stirrup shaped stem 19, moves bolt 17 so that bolt head 18 is withdrawn from recess 27. The door may then be pushed open.

As the door is opened, the outer end 20 of plunger rod 12 is no longer engaged by bridge portion 28 of striker plate 25, and first compression spring 15 returns the mechanism to the configuration of FIG. 1.

As already stated, the latch bolt mechanism according to the present invention is particularly suitable for remote electronic operation. For example, the mechanism described with reference to the drawings may be modified by the provision of a solenoid to move the releasable retainer 29. Such a solenoid has only to overcome the resistance of the small fourth compression spring 31, and can therefore be smaller and less demanding of power than a solenoid in a conventional bolt mechanism which must overcome greater resistance directly to draw the bolt.

What is claimed is:

1. A latch bolt mechanism for a door and adapted to co-operate with a striker plate, said mechanism comprising, in combination:

frame means adapted to be mounted in fixed relationship to said door;

a plunger rod having a head end and a tail end and movable relative to said frame means longitudinally between a first limiting position in the direction defined by its head end and a second limiting position in the direction defined by its tail end and having means associated with its head end to engage said striker plate when said door is closed whereby said rod is prevented from attaining its said first limiting position;

first spring means tending to urge said rod towards its first limiting position relative to said frame means;

a bolt slidably mounted on said rod near its head end and movable relative to said frame means between a protrudent position at which in use it may engage said striker plate and a withdrawn position at which in use it will clear said striker plate;

an actuator slidable on said rod relative to each of said frame means and said bolt and limited in its ability to move towards the tail end of said rod relative to said bolt by means on said actuator which engage co-operating means on said bolt;

second spring means acting directly on said actuator and tending to urge said actuator relative to said bolt towards the tail end of said rod;

third spring means also acting directly on said actuator and tending to urge said actuator relative to said rod towards the tail end of said rod; and releasable retaining means movable relative to said frame means able to lock said actuator in a fixed position relative to said frame means against the influence of said second and third spring means.

2. A latch bolt mechanism for a door and adapted to co-operate with a striker plate, said mechanism comprising, in combination:

a casing adapted to be mounted in fixed relationship to said door;

a plunger rod having a head end and a tail end and movable relative to said casing longitudinally between a first limiting position in the direction defined by its head end and a second limiting position in the direction defined by its tail end, the head end being adapted to engage said striker plate when said door is closed whereby said rod is prevented from attaining its said first limiting position;

a first compressing spring sleeved on said rod and so placed as to urge said rod towards its first limiting position relative to said casing;

a bolt slidably mounted on said rod near its head end and movable relative to said casing between a protrudent position at which in use it may engage said striker plate and a withdrawn position at which in use it will clear said striker plate;

an actuator slidable on said rod relative to each of said casing and said bolt and limited in its ability to move towards the tail end of said rod relative to said bolt by means on said actuator which engage co-operating means on said bolt;

a second compression spring sleeved on said rod and so placed as to bear directly against said actuator to urge said actuator relative to said bolt towards the tail end of said rod;

a third compression spring sleeved on said rod and so placed as to urge said actuator relative to said rod towards the tail end of said rod; and releasable retaining means movable relative to said casing able to lock said actuator in a fixed position relative to said casing against the influence of said second and third spring means.

3. A latch bolt mechanism for a door and adapted to cooperate with a striker plate, said mechanism comprising, in combination:

a casing adapted to be mounted in fixed relationship to said door;

a plunger rod having a head end and a tail end and movable relative to said casing longitudinally between a first limiting position in the direction defined by its head end and a second limiting position in the direction defined by its tail end, the head end being adapted to engage said striker plate when said door is closed whereby said rod is prevented from attaining its said first limiting position;

a first compressing spring sleeved on said rod and so placed as to urge said rod towards its first limiting position relative to said casing;

a bolt slidably mounted on said rod near its head end and movable relative to said casing between a protrudent position at which in use it may engage said striker plate and a withdrawn position at which in use it will clear said striker plate;

an actuator slidable on said rod relative to each of said casing and said bolt and limited in its ability to move towards the tail end of said rod relative to said bolt by means on said actuator which engage cooperating means on said bolt;

a second compression spring sleeved on said rod and so placed as to urge said actuator relative to said bolt towards the tail end of said rod;

a third compression spring sleeved on said rod and so placed as to urge said actuator relative to said rod towards the tail end of said rod;

releasable retaining means movable relative to said casing able to lock said actuator in a fixed position relative to said casing against the influence of said second and third spring means;

wherein said bolt comprises a bolt head and a stirrup shaped stem sleeved on said plunger rod, said actuator consists of a plate having front and rear flanges sleeved on said rod, said front flange being housed within said stirrup shaped stem.

4. A latch bolt mechanism according to claim 3, wherein said rod comprises a front abutment flange housed within said stirrup shaped stem and able to contact said bolt head and a rear abutment flange between said actuator and the end wall of said casing; said first compression spring is located between said rear abutment flange and said end wall; said second compression spring is located between the rear flange of said actuator and said stirrup shaped stem; and said third compression spring is located between the front flange of said actuator and said front abutment flange.

* * * * *